United States Patent [19]

Day et al.

[11] Patent Number: 4,745,910

[45] Date of Patent: May 24, 1988

[54] PERCUSSOR TO AID IN REMOVAL OF LUNG SECRETIONS, AND METHODS

[75] Inventors: H. Kirt Day, Ogden; John Goodrich, Taylorsville, both of Utah

[73] Assignee: Ballard Medical Products, Midvale, Utah

[21] Appl. No.: 35,850

[22] Filed: Apr. 8, 1987

[51] Int. Cl.[4] ..... A61H 31/00

[52] U.S. Cl. ..... 128/28; 128/54; 128/67

[58] Field of Search ..... 128/28, 54, 55, 67, 128/38–40, 41, 60, 30; 403/247, 275; 24/621, 623, 297

[56] References Cited

U.S. PATENT DOCUMENTS

| | | | |
|---|---|---|---|
| 2,054,849 | 9/1936 | Briggs | 128/54 |
| 3,008,169 | 11/1961 | Dearling | 128/54 |
| 4,196,722 | 4/1980 | Vanderwoude | 128/28 |
| 4,429,688 | 2/1984 | Duffy | 128/28 |
| 4,635,326 | 1/1987 | Yagi | 24/297 X |

FOREIGN PATENT DOCUMENTS

| | | | |
|---|---|---|---|
| 24106 | of 1893 | United Kingdom | 128/54 |

OTHER PUBLICATIONS

DHD Medical Products literature.

*Primary Examiner*—Richard J. Apley
*Assistant Examiner*—Howard Flaxman
*Attorney, Agent, or Firm*—Lynn G. Foster

[57] ABSTRACT

A percussor for respiratory percussion therapy, comprising a lightweight flexible cantilever handle and a soft elastomeric percussion cup secured to the distal end of the handle. The bell-shape of the percussion cup provides a highly effective percussion shock wave and sound, while accommodating a wide range of striking forces and angles relative to any desired body surface. A lip having a large surface area substantially avoids irritation, trauma and injury to the patient.

15 Claims, 1 Drawing Sheet

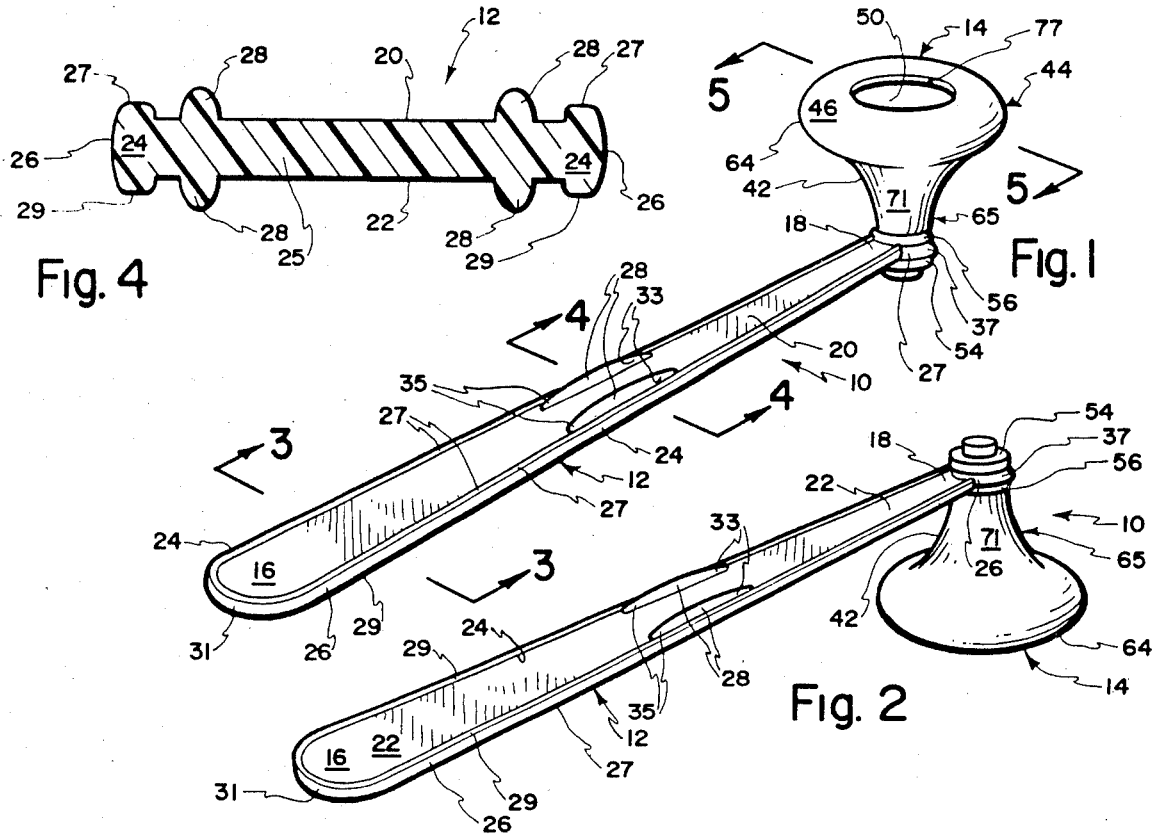
Fig. 4
Fig. 1
Fig. 2
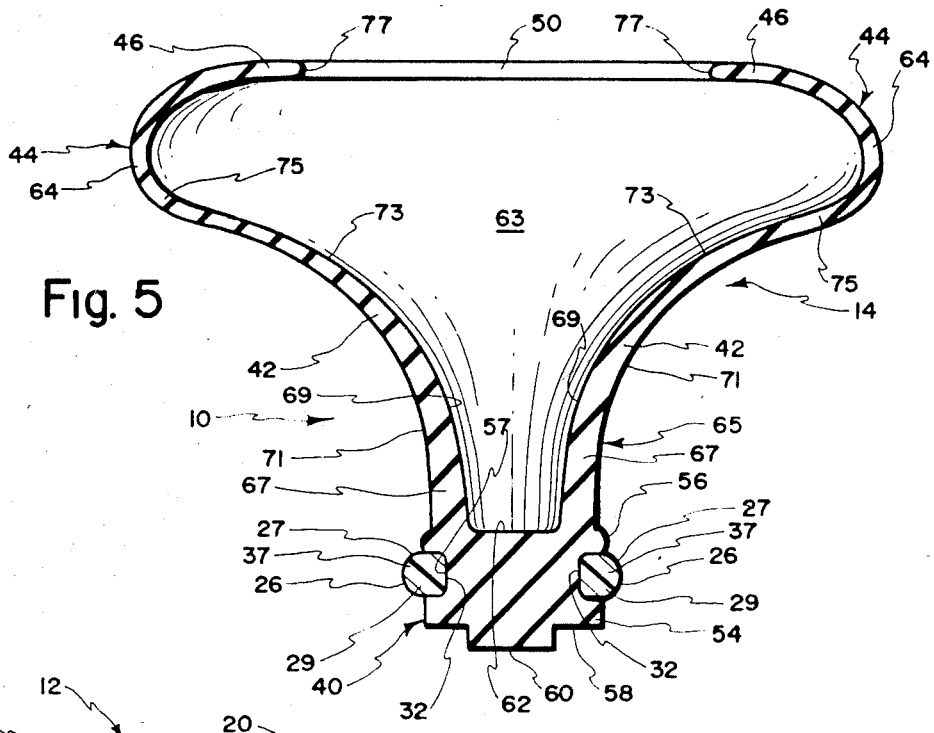
Fig. 5
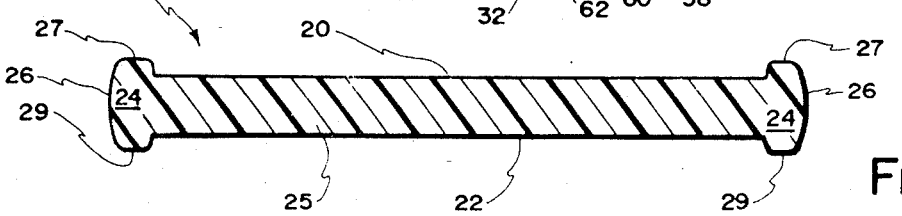
Fig. 3

PERCUSSOR TO AID IN REMOVAL OF LUNG SECRETIONS, AND METHODS

FIELD OF THE INVENTION

The present invention relates generally to medical instruments for removal of lung secretions, and more particularly to a percussor, and related methods, for mobilizing secretions in the lungs to aid in the removal thereof.

PRIOR ART

It is an ancient medical practice to use a rhythmic clapping or thumping over the chest and back to mobilize secretions in the lungs for subsequent expectoration. Such practice has been an integral part of pulmonary physiotherapy for such ailments as cystic fibrosis, tuberculosis, pneumonia, and other pulmonary diseases. In the past, such treatments have generally been performed with the fingers or hand, but today these treatments are often performed with instruments or machines as well.

The treatment techniques heretofore proposed in the aforementioned art have a number of drawbacks. First, the degree of force required to induce efficacious vibrations is often traumatic, painful or injurious to the patient. This problem is exacerbated by the fact that the thumping is rhythmically performed at a speed on the order of 200 percussions per minute, and often in the same area for several minutes at a time. Several hundred such percussions may, therefore, be performed in one area of the chest or back over a short period of time, often causing soreness and reddening of the skin in that location.

A hollow popping or thumping vibratory noise is usually the most effective in dislodging secretions. However, there is no simple way to effectively and consistently produce such a sound in the absence of an operative instrument. While the hand may be cupped and clapped over the chest and back, the cupped hand is larger and more forceful than is generally desired for such treatment, particularly with infants, small children, or elderly persons. Using the tips of the fingers does not generally produce the essential hollow sound, unless they are struck against the rib cage with sufficient force to resonate. Such a degree of force typically causes unacceptable patient discomfort, especially if repeated many times in one place and on a repetitive basis from day-to-day. A further drawback is that the technique, if improperly performed, can cause penetration of the skin by the fingernails and bruising of tissue.

Respiratory percussion therapy is a highly individualized treatment. A skilled therapist can discern from a change in the resonance of the chest, where the secretions are lodged, and adjust the treatment accordingly. The percussion treatment is varied in rhythm, in force, in direction, and in location to achieve the greatest effectiveness for the individual patient.

Recently, vibrating and percussion machines have been used in respiratory therapy treatments. However, such machines are expensive and relatively complex. They do not work as well as manual techniques. First, the sound of the motor interferes with the therapist's ability to discern where the secretions are in the chest. Furthermore, the speed of the percussions are only variable on the more expensive machines. The direction of the percussion is often difficult to adjust because of the size and weight of the machine, so the patient is generally manipulated instead. With most percussion machines, the force of the percussion is not adjustable at all. Finally, most of the motorized devices must be used with a heavy towel or other padding over the skin because of their propensity to irritate and occasionally even pinch or shear the skin and bruise.

One known handheld device available from DHD Medical Products comprises a generally cylindrical handleless rubber resonating chamber, closed at the top, with a necked-down portion at the top adapted to fit directly between the fingers for use in the hand. A flat lip at the bottom of the chamber disperses the striking force over a broad area, while a central opening in the lip communicates between the resonating chamber and the body of the patient. The DHD device is awkward to use, and is, therefore, fatiguing to the hand and arm. It is too large for use with infants and small children, and does not allow a wide latitude of forces and directions to be used in the treatment.

BRIEF SUMMARY AND OBJECTS OF THE INVENTION

In brief summary, the present invention overcomes or substantially alleviates the aforementioned problems of the prior art. It comprises a percussor and methods. A low-cost, hand-operated percussor is provided, which comprises a percussor head carried in cantilevered fashion at the distal end of an elongated handle. The present invention accommodates facile provision of the force, rhythm, directionality and control for producing the desired reverberatory sound. It causes less trauma, irritation and injury to the patient and less fatigue to the therapist.

The present invention provides a novel percussor comprising a resilient percussion cup attached to an elongated handle. The proximal end of the handle is manually manipulated in hammer-like strokes to rhythmically strike the percussion cup against the chest and back of the patient, typically several hundred times a minute. Operation of the device is uniform or consistent and the device is easy to operate for extended periods. It is neither traumatic nor injurious to the patient nor tiring to the user. The device may be used in virtually any position and from any direction.

The percussion cup has a hollow resonating chamber which provides a highly effective percussion sound with a minimum of applied force. The cup accommodates a wide range of striking forces and striking angles relative to the body surface. Preferably, a wide, soft and rounded lip, located the striking surface of the cup, reduces irritation to the patient's skin and makes the likelihood of injury remote.

With the foregoing in mind, it is a principal object of the current invention to provide a novel, highly effective and low-cost manual percussor for mobilizing secretions in the lungs, and related methods.

It is a further paramount object of the present invention to prevent patient trauma, discomfort and injury, during use of the manual percussor and methods of the present invention.

It is a further important object of the present invention to provide a percussion device which is easily used by a therapist in any desired position, reducing the need for manipulation of the patient.

It is an additional dominant object of the present invention to provide a novel non-mechanical percussor and related methods.

It is an additional significant object to provide a novel manual percussor, which is low cost and handheld and comprises a percussor head carried in cantilevered fashion at the distal end of an elongated, flexible handle.

An additional object of significance is the provision of a novel percussor which accommodates facile manual provision of the requisite force, rhythm, directionality and control for producing the necessary reverberatory sound to mobilize secretions in the lungs of a medical patient.

A further object of paramount importance is the provision of a novel manual percussor and related method which comprises a cantilevered yieldable handle which carries at the distal end thereof a resilient hollow percussor head which is manipulated from the proximal end of the handle in hammer-like strokes to cause the cup to rhythmically strike the desired location of the patient up to several hundred times per minute uniformly and consistently for extended periods of time, whereby trauma and/or injury to the patient is minimal and use of the percussor is not tiring to the therapist.

These and other objects and features of the present invention will be apparent from the detailed description taken with reference to the accompanying drawings.

BRIEF DESCRIPTION OF THE DRAWINGS

FIG. 1 is a perspective view of a manual respiratory percussor fabricated according to the principles of the present invention, with the percussor head or cup thereof in an upwardly-directed disposition;

FIG. 2 is a perspective view of the percussor similar to FIG. 1, showing the percussor head or cup in an inverted disposition;

FIG. 3 is a transverse cross-section taken along the lines 3—3 of FIG. 1;

FIG. 4 is a transverse cross-sectional view taken along the lines 4—4 of FIG. 1; and FIG. 5 is a transverse cross-section taken along the lines 5—5 of FIG. 1.

DETAILED DESCRIPTION OF THE ILLUSTRATED EMBODIMENT

Reference is now made to the drawings wherein like numerals are used to identify like parts throughout. More particularly, FIGS. 1 and 2 show a respiratory percussion device or percussor, generally designated 10. The percussor 10 comprises a percussion cup 14 and an elongated handle 12, which is manually used, in a cantilevered fashion, to reciprocally swing a percussion cup 14 in gentle hammer-like strokes against the chest, side or back of a patient to mobilize secretions accumulated in the lungs of the patient for removal using an aspirating catheter tube, for example.

The handle 12 is formed as a single piece, preferably using injection molding techniques and a shape-retaining synthetic resinous material, such as ABS. The handle 12 is elongated, i.e. relatively long and slender in its configuration. The handle 12 comprises a distal end portion 16 and a proximal end portion 18. The thickness of the handle 12 is substantially uniform along its entire length. The width of the handle 12, however, tapers divergently from the proximal end 16 to the distal end 18, as best illustrated in FIGS. 1 and 2. The handle 12 is essentially intended to function as a cantilever beam which is displaced (flexed) to and fro in an up and down motion, as viewed in FIG. 2, by reciprocating action of the hand of the therapist which grips the proximal end 16 between the thumb and one or more fingers of one hand. This causes the distal part of the cup 14 to repeatedly strike the torso of the patient at a desired site with a cushioned impact causing a clapping sound and causing a shock wave to be imparted to the patient at the selected torso site.

The handle 12 comprises a rounded edge 26 which traverses the entire handle 12 and forms part of a peripheral strengthening rib 24, which extends both upwardly and downwardly above the central web 25 of the handle. The web 25 is illustrated, in FIGS. 3 and 4, as having, with one exception, a uniform thickness throughout defined by parallel exposed web surfaces 20 and 22. The surface 20 merges with the flange projection 27 at opposite edges of the handle 12, while surface 22 merges with the flange portion 29 at opposite edges as well. The flange portion 27 and 29 together comprise the aforementioned perimeter rib 24.

While the dimensions selected for the handle 12 may vary, one presently preferred configuration uses a handle having a length of $7\frac{1}{2}$ inches, a minimum width, out-to-out, directly adjacent the cup 14 of 9/32nds of one inch, a maximum width at the distal end 16 of 19/32nds of one inch, a depth, at rib 24, of about 3/32nds of one inch and a web thickness at web 25 of about 2/32nds of one inch.

The handle 12 is illustrated as comprising an arcuate proximal edge 31 and opposed pairs of integral strengthening ribs 28 which extend bi-directionally parallel the flanges 27 and 29 to each side of the web 25 at essentially the mid-point along the length of the handle 12. Thus, the pair of strengthening ribs 28 on each side of the web 25 divergently taper, in respect to each other, toward the proximal end 18. The ribs 28 also have feathered leading and trailing edges 33 and 35, respectively. The central portion of each rib 28 between the feathered ends 33 and 35 has a uniform cross-section. The size of the ribs 28 can vary so long as the ribs 28 collectively create a rigidified fulcrum about which the distal end 18 of the handle 12 will flex to and fro when manually manipulated as indicated earlier without structural failure. In the illustrated embodiment, the strengthening ribs 28 are illustrated as projecting away from the surfaces 20 and 22 of the web 25, a distance greater than the corresponding projection of the flanges 27 and 29. See FIG. 4.

The proximal end 18 terminates in an annular loop, eyelet or ring 37. The loop 37 is essentially a continuation of the flange 24 and the rounded edge 26. The uniform interior diameter of the loop or eyelet 37 is defined by relatively flat surface 32. The diameter may be 11/32nds of one inch, when the dimension configuration of the handle mentioned previously is used. The opening created at surface 32 is used to receive a necked down stem portion of the cup 14, in a manner and for a purpose hereinafter more fully explained.

It is to be appreciated that when the therapist discontinues his manual displacement of the device 10 (incurred through the therapist's hand located at proximal end 16 of the handle 12), the handle 12 will return to its linear unstressed configuration illustrated in FIGS. 1 and 2.

The percussion cup 14 comprises a mounting plug or stem, generally designated 40, which is force-fit through the opening 32 in the eyelet or ring 37, as hereinafter more fully explained. The plug or stem 40 comprises first and second spaced rings 54 and 56, each of which is directed essentially parallel to but slightly offset from the plane containing the ring 37, and, therefore, transverse to the axis of the cup 14. The rings 54 and 56 have diameters which substantially exceed the diameter of the ring opening 32 and are spaced from each other by a distance substantially equal to the thickness of the ring 37.

The stem 40 is illustrated as being formed integral with the remainder of the cup 14 and comprises a solid core of material terminating in a cylindrical button 60, which is residual from the molding process by which the cup 14 is formed. The material from which the cup 14 is formed as one piece, preferably by injection molding, is preferably a latex or similar soft synthetic rubber material, which is highly yieldable and resilient and yet highly wear resistant. KRAYTON resin, available from Shell Petroleum is suitable and presently preferred.

The rings 54 and 56 define therebetween a groove 57, a diameter of which is substantially the same as the diameter of the opening 32 in the ring 37. The handle, at the distal loop 37, is caused to be united with the cup 14 by forcing the ring 37 over the button 60 and compressively over the flange 54, causing the flange 54 to be radially compressed and distorted until the ring 37 comes to rest as illustrated in FIG. 5, at which time, the memory of the material from which the flange 54 is made causes the flange 54 to return to its fully expanded, unstressed condition, whereby the cup 14 is suspended from the ring 37 at the proximal end 18 of the handle 12 for the use mentioned heretofore.

The mounting plug or stem 40 internally terminates at planar surface 62, which forms the relatively small internal circular base of the resonance chamber 63. Resonant chamber 63 is illustrated as being generally bell-shaped in its configuration. The neck 65 of the hollow bell-shaped housing 44 of the cup 14 comprises an annular wall 67 the thickness of which progressively decreases in a direction away from the stem or plug 40. In other words, the thickness of the walls 67 decreases as the chamber space formed within the annular wall 67 enlarges. The wall 67 comprises an interior convex curvilinear annular surface 69 and an exposed concave curvilinear annular surface 71. The surface 69 also forms part of the resonance chamber 63. The decrease in the thickness of the wall 67 terminates at annular site 73. The wall thereafter is illustrated as being of substantially uniform thickness. The direction of curvature along surfaces 69 and 71 reverses at annular site 75. The rate of curvature at reversal site 75 is substantially increased as well to form the bulbous distal end portion 64 of the bell-shaped cup 14. The bulbous distal portion 64 has a diameter several times greater than the diameter of flange 56 and terminates in a generally inwardly-directed, large area lip 46. The lip 46 terminates in a smooth edge 77. Edge 77 defines a symmetrical circular opening 50 to the chamber 63. The opening 50 and the annular edge 77 are collectively contained within a common plane illustrated as being disposed transverse to the axis of the cup 14.

The described configuration of the cup 14, during use, accommodates a partial collapsing and suction action by the bell-shaped housing 44 when the patient is struck, followed by a restoration to the unstressed configuration and the release of a slight vacuum within the chamber 63, when contact with the patient is discontinued. This occurs in a rapid repetitive fashion to accommodate use of the percussor 10 to effectuate a percussion vibration through a broad range of forces and locations along the torso of the patient, the annular lip 46 preferably striking the surface of the patient, independent of the location thereof, in an essentially flush relation whereby secretions contained in the lungs are better mobilized for removal under force of negative pressure through an aspirating catheter tube. Because the bulbous segment 64 collapses and the bell-shaped housing 44 flexes at site 73, the impact is a cushioned blow.

The cup 14 is entirely symmetrical about its longitudinal axis, which axis is disposed in transverse relation to the axis of the handle 12, when the handle 12 is in its illustrated, unstressed condition. Thus, the percussor is essentially hammer-shaped. The nature of the thicker wall 67 prevents collapse or buckling of that wall adjacent the stem 40 and restricts the action of the cup 14 to that of flexing annularly around the site 73 coupled with a collapsing of the bulbous segment 64 so that flange 46 tends to contact site 73 during use. Thus, the size of the percussion chamber 63 is substantially reduced upon impact when the lip 46 is caused to strike the patient and is immediately thereafter enlarged by the memory of the bulbous segment 64 when the percussor is manually retracted and the lip 46 ceases to be contiguous with the patient. The resulting clapping or thumping sound is a guide to the therapist as to whether or not the cup 14 is being properly impinged upon the torso of the patient and whether secretions are within the lungs adjacent the contact site, so that immediate adjustment can be made for proper mobilization of secretions.

The lip 46, as it makes contact with the torso of the patient, also serves to create a seal as a portion of the air contained within the chamber 63 is expelled therefrom and an instantaneous vacuum created. Thus, a clapping noise and a shock wave are created. The shock wave passes from the chamber 63 through the aperture 50 thereof into the body of the patient where it performs its therapeutic function. The lip 46 also serves to distribute over a relatively large area the force of each blow cyclically imposed upon the torso of the patient so that there is essentially no appreciable patient discomfort or trauma. The soft nature of the lip 46 prevents injury to the patient as well.

Because of the manner in which the device 10 is hand-operated, the therapist has the full range of control over force, direction and rhythm. Consequently, the percussor 10 provides a more effective percussion instrument for comfortable, short or long-term use by the therapist supplying a non-traumatic, non-injurious effect upon the patient. The device is particularly useful for neonate, pediatric and other patients, including adult patients, independent of whether the patient is intubated and independent of whether the patient is being subjected to involuntary ventilation. The percussor 10 may be used in the presence of rib fractures, chest tubes, and subcutaneous emphysema.

Using a handle 12 having the preferred dimensions mentioned earlier, the bell-shaped cup 14 may be constructed wherein the diameter of the opening 50 is on the order of $\frac{7}{8}$ths of one inch, the maximum diameter of the bulbous segment 64 is $1\frac{3}{4}$ths inches, the axial thickness of the ring 54 is 1/16th of one inch, the thickness of the ring 56 is 1/32nd of one inch, the diameter of the rings 54 and 56 is 7/16ths of one inch and the distance from the zenith of the bulbous section 64 to the ring 56 is $\frac{7}{8}$ths of one inch, the thickness of the lip 46 is 0.040, the thickness of the wall 42 between annular locations 73 and 75 is 0.065 and the maximum thickness of the wall 67 adjacent surface 62 is 0.095.

The invention may be embodied in other specific forms without department from the spirit or essential characteristics thereof. The present embodiment, is, therefore, to be considered in all respects as illustrative and not restrictive, the scope of the invention being indicated by the appended claims rather than by the foregoing description, and all changes which come within the meaning and range of equivalence of the claims are therefore to be embraced therein.

What is claimed and desired to be secured by United States Letters Patent is:

1. A manually operable percussor for repeated use to gently strike the exterior of a medical patient adjacent the lungs to mobilize lung secretions without causing material patient discomfort, trauma or injury comprising:

handle means comprising beam means having a proximal end portion by which the percussor is grasped in one hand of the user, a distal end portion and an elongated central portion integral with both the proximal and distal end portions;

a bell-like elastomeric percussor head having a longitudinal axis and the general shape of a light bulb, the percussor head comprising (a) a relatively narrow top neck which comprises means by which the percussor head is connected to the distal end portion of the handle means, (b) a central portion comprising a hollow interior chamber defined by a downwardly diametrically expanding bell-shaped wall the maximum diameter of which is several times greater than the neck and (c) a bottom elongated thin lip which is cantilever joined at an annular site to the bell-shaped wall and which extends inwardly toward the axis of the head in a direction generally transverse to said axis, the lip terminating in an edge disposed in a plane which is transverse to the axis of the head, the edge defining an opening to the chamber, the size of the opening being substantially less than the maximum diameter of the bell-shaped wall and the lip comprising a large inwardly extending exposed bottom impact surface area, whereby the user grasps the proximal end portion of the cantilever beam means and by hammer-like short to and fro strokes causes the inwardly directed large bottom surface area to repeatedly, gently and yieldably strike one or more predetermined external sites at the torso of the medical patient to create a series of shock waves within the chamber and to direct said shock waves into the patient at the one or more predetermined external torso sites to mobilize lung secretions.

2. A hammer-shaped manual percussor for mobilizing lung secretions comprising a relatively long, relatively slender handle having proximal end to be gripped in one hand of the user, the percussor further comprising a hollow, relatively soft cupular one-piece elastomeric head attached at the top thereof and having a longitudinal axis disposed in substantially transverse relation to the longitudinal axis of the handle and comprising a diametrally enlarged chamber-forming bell-shaped housing, constricted substantially diametral reduced chamber opening at the bottom of the percussor head and a nonreinforced thin wall lip, the lip being directed inwardly toward the axis of the head and spanning between the chamber opening and an annular cantilever site where the lip is integrally joined to the bell-shaped housing, the lip comprising a large flat yieldable exposed bottom impact surface area.

3. A hammer-shaped manual percussor for mobilizing lung secretions comprising a relatively long, relatively slender handle having proximal end to be gripped in one hand of the user, the percussor further comprising a hollow, relatively soft cupular one-piece elastomeric head attached at the top thereof and having a longitudinal axis disposed in substantially transverse relation to the longitudinal axis of the handle and comprising a chamber-forming bell-shaped housing comprising a first wall section which continuously curves downwardly and outwardly away from the axis of the head and a second wall section which integrally merges with the first wall section and thereafter curves continuously downwardly and inwardly toward the axis of the head, a constricted substantially diametral reduced chamber opening at the bottom of the percussor head and a thin wall lip, the lip being directed inwardly toward the axis of the head and spanning between the chamber opening and an annular cantilever site where the lip is integrally joined to the second wall section, the lip comprising a large flat yieldably exposed bottom impact surface area.

4. A percussor according to claim 1 wherein the central portion of the cantilever beam means comprises flexure means at which the cantilever beam means flexes first in one direction and then in an opposite direction during use.

5. A percussor according to claim 1 wherein the cantilever beam means comprise strengthening reinforcing structure at the central portion thereof in the form of reinforcing ribs.

6. A percussor according to claim 1 wherein the cantilever beam means comprise an integral ring at the distal end portion thereof which surroundingly is joined to the neck of the percussor head.

7. A percussor according to claim 1 wherein the cantilever beam means are divergently tapered from the proximal toward the distal end so that the cantilevered beam means are ore rigid and less yieldable at the proximal end portion than at the central portion and the distal end portion.

8. A percussor according to claim 1 wherein the percussor head is comprised of one piece molded soft synthetic resinous material.

9. A percussor according to claim 1 wherein the hollow bell-shaped wall and the lip partially collapse and somewhat flex to a degree each time the large inwardly extending impact surface area is caused to strike the patient, thereby causing a cushioning effect without inhibiting secretion mobilization.

10. A percussor according to claim 1 wherein the chamber defining bell-shaped wall comprises maximum diameter means which partially collapse and somewhat flex each time the large inwardly extending impact surface area is caused to strike the patient.

11. A percussor according to claim 1 wherein the large inwardly extending impact surface area creates an instantaneous seal with the patient each time the distal impact means are caused to strike the patient.

12. A percussor according to claim 1 wherein the large inwardly extending impact surface area creates an instantaneous seal with the patient each time the distal impact means are caused to strike the patient and wherein the chamber defining bell-shaped wall partially collapses and somewhat flex each time the large inwardly extending impact surface area strike the patient whereby the pressure within the chamber creates noise and shock waves which vary with the change in pressure within the chamber from atmospheric to above-atmospheric to negative pressure during use.

13. A percussor according to claim 1 wherein the neck comprises compressible means with memory which are compressibly united with the distal end portion of the cantilevered beam means, with the memory of the compressible means securing the cantilever beam means to the neck of the percussor head against inadvertent separation.

14. A percussor according to claim 13 wherein the compressible means comprise neck stem means disposed at the top of the percussor head.

15. A percussor according to claim 1 wherein the longitudinal axis of the cantilever beam means is disposed in transverse relation to the longitudinal axis of the percussor head.

* * * * *